US008224217B2

(12) United States Patent
Park

(10) Patent No.: US 8,224,217 B2
(45) Date of Patent: Jul. 17, 2012

(54) DEVELOPING UNIT AND IMAGE FORMING APPARATUS EMPLOYING THE SAME

(75) Inventor: Jong-hyun Park, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 635 days.

(21) Appl. No.: 12/350,278

(22) Filed: Jan. 8, 2009

(65) Prior Publication Data

US 2010/0008702 A1 Jan. 14, 2010

(30) Foreign Application Priority Data

Jul. 11, 2008 (KR) ..... 10-2008-0067760

(51) Int. Cl.
*G03G 15/09* (2006.01)

(52) U.S. Cl. ..... 399/274

(58) Field of Classification Search ..... 399/274–278, 399/282, 284, 267
See application file for complete search history.

(56) References Cited

U.S. PATENT DOCUMENTS 5,978,623 A * 11/1999 Itoh ..... 399/104

FOREIGN PATENT DOCUMENTS

| | | |
|---|---|---|
| JP | 2000206788 | 7/2000 |
| JP | 2001215795 | 8/2001 |

* cited by examiner

*Primary Examiner* — David Gray
*Assistant Examiner* — Ruth Labombard
(74) *Attorney, Agent, or Firm* — Stanzione & Kim, LLP

(57) ABSTRACT

A developing unit to develop an image on an image support body and an image forming apparatus employing the same. The developing unit includes a housing to contain a developer having a toner and a carrier, a magnetic cylinder including a catch pole to pick up the developer in the housing and a main pole arranged to face the image support body and to hold the carrier of the developer, a sleeve installed to rotate on the magnetic cylinder and on which a developer layer is formed, a thickness regulating member to regulate a thickness of the developer layer, and a width regulating member to regulate a width of the developer layer on the sleeve.

14 Claims, 10 Drawing Sheets

DEVELOPING UNIT AND IMAGE FORMING APPARATUS EMPLOYING THE SAME

CROSS-REFERENCE TO RELATED APPLICATIONS

This application claims priority from Korean Patent Application No. 10-2008-0067760, filed on Jul. 11, 2008 in the Korean Intellectual Property Office, the disclosure of which is incorporated herein by reference.

BACKGROUND OF THE INVENTION

1. Field of the Invention

The present general inventive concept relates to a bi-component type developing unit and an image forming apparatus employing the same, and more particularly, to a developing unit which can prevent developer scattering and image loss and an image forming apparatus employing the same.

2. Description of the Related Art

In general, a bi-component developing unit uses a developer made of a toner for forming an image and a carrier for carrying the toner by a magnetic force, so as to develop an image. This developing unit includes a developing member having a magnetic cylinder and a sleeve installed to rotate on the cylinder, so as to separate the toner from the developer to form a toner image on an image support body. The magnetic cylinder has a catch pole for adsorbing the developer onto the sleeve, a main pole facing the image support body and directly contributing to development, a feeding pole for feeding the carrier remaining on the sleeve after the development, and a separating pole for separating the fed carrier from the sleeve.

FIG. 1 is a plan view illustrating a conventional developing unit, and FIG. 2 illustrates an axial magnetic force distribution of a magnetic cylinder with respect to a main pole, a catch pole and a feeding pole of the magnetic cylinder.

Referring to FIGS. 1 and 2, a magnetization width $W_1$ of each of the plurality of magnetic poles constituting a magnetic cylinder 1*a* is the same as a width $W_2$ of a developer layer formed on a sleeve 1*b*. A pair of sealing members 3 is provided between opposite end parts of the developer layer and opposite end parts of the sleeve 1*b* to prevent a developer D from leakage at opposite end parts of a developing member 1.

According to the above developing unit, a main pole N1 is configured such that magnetic forces A and B at opposite end parts of the main pole N1 are larger than a magnetic force C at a central part thereof due to an edge effect of a magnetic field generated at the opposite end parts of the main pole N1, as shown in FIG. 2. Thus, the thickness of a developer layer becomes high at the opposite end parts, and thus, developer distribution at a developing nip position of the image support body or at the main pole N1 extends toward the opposite end parts (refer to D1 in FIG. 1). Thus, the developer may leak at the opposite end parts of the main pole N1.

On the other hand, in a catch pole N2 and a feeding pole N3, magnetic forces at opposite end parts are smaller than those at central parts in a direction parallel to a longitudinal axis of the magnetic cylinder. Accordingly, the developer distribution is out of balance, and thus, the amount of the developer picked up at one end part of the catch pole N2 becomes deficient. Thus, as illustrated in FIG. 3, an image loss 11 may occur at one end part 10*a* of a developed image 10.

SUMMARY OF THE INVENTION

The present general inventive concept provides a developing unit which can prevent leakage of a developer and image loss at an end part of a developing member, and an image forming apparatus employing the same.

Additional aspects and utilities of the present general inventive concept will be set forth in part in the description which follows and, in part, will be obvious from the description, or may be learned by practice of the general inventive concept.

In an embodiment and utility of the present general inventive concept, there is provided a developing unit to develop an image on an image support body, the developing unit including a housing to contain a developer having a toner and a carrier, a magnetic cylinder having a catch pole to pick up the developer in the housing and a main pole arranged to face the image support body and to hold the carrier of the developer, a sleeve installed to rotate on the magnetic cylinder and on which a developer layer is formed, a thickness regulating member to regulate a thickness of the developer layer, and a width regulating member to regulate a width of the developer layer on the sleeve to satisfy the following formula:

$$W_M \geqq W_{D2} \geqq W_{D1} \geqq W_{Imax},$$

where $W_M$ refers to a magnetization width of the magnetic cylinder, $W_{D2}$ refers to a width of the developer layer at the catch pole, $W_{D1}$ refers to a width of the developer layer between the catch pole or the thickness regulating member and a developing area formed between the sleeve and the image support body, and the $W_{Imax}$ refers to a maximum image width capable of being developed on the image support body.

The thickness regulating member may be spaced from the sleeve at a predetermined gap along a lengthwise direction of the sleeve between the catch pole and the main pole.

The magnetic cylinder may further include: at least one feeding pole feeding the developer layer on the sleeve; and a separating pole separating the developer from the sleeve.

The width regulating member may include: a first width regulating member arranged at opposite end parts of the sleeve and regulating the developer layer to maintain the width $W_{D1}$; and a second width regulating member arranged at the opposite end parts of the sleeve, regulating the developer layer to maintain the width $W_{D2}$, and preventing leakage of the developer.

The first width regulating member may contact the opposite end parts of the sleeve between the thickness regulating member and the main pole and regulate the width of the developer layer in contact with the sleeve.

The first width regulating member may be arranged at a lower end part of the thickness regulating member to contact the opposite end parts of the sleeve and regulate the width of the developer layer in contact with the sleeve.

The first width regulating member may include a regulating magnet which is arranged to face the opposite end parts of the sleeve between the thickness regulating member and the main pole and which regulates the width of the developer layer by a magnetic force.

In an embodiment and utility of the present general inventive concept, there is also provided a developing unit developing an image on an image support body, including, a housing to contain a developer, a developing member installed in the housing to supply the developer to the image support body and to form a developing area between the developing member and the image support body, a thickness regulating member to regulate a thickness of a developer layer formed on the developing member, and a first width regulating member arranged between the thickness regulating member and the developing area at at least one side of the developing member to regulate the width of the developing layer.

The developer may be a bi-component developer including a toner and a carrier carrying the toner.

The first width regulating member may include a plurality of sealing members contacting opposite end parts of the developing member and regulating the width of the developer layer in contact with the developing member.

The developing member may include a magnetic cylinder having a catch pole to pick up the developer in the housing, and a main pole to face the image support body and to hold the carrier of the developer, and a sleeve installed to rotate on the magnetic cylinder and on which the developer layer is formed.

The developing unit may further include a second width regulating member arranged between the developing area and the thickness regulating member along a rotational direction of the developing member at at least one end part of the developing member, and to regulate the width of the developer layer.

The first and second width regulating members regulate the width of the developer layer on the sleeve to satisfy the following formula:

$$W_M \geqq W_{D2} \geqq W_{D1} \geqq W_{Imax},$$

where $W_M$ refers to a magnetization width of the magnetic cylinder, $W_{D2}$ refers to a width of the developer layer at the catch pole, $W_{D1}$ refers to a width of the developer layer between the catch pole or the thickness regulating member and a developing area formed between the sleeve and the image support body, and the $W_{Imax}$ refers to a maximum image width capable of being developed on the image support body.

In an embodiment and utility of the present general inventive concept, there is also provided an image forming apparatus including an image support body, an electrifying member to electrify the image support body, an exposure unit to expose the image support body to form a latent image such that developing units forms a visible image corresponding to the latent image on the image support body, a transfer unit to transfer the image on the image support body onto a printing medium, and a fusing unit fixing the image transferred on the printing medium.

In an embodiment and utility of the present general inventive concept, there is also provided a developing unit to contain a developer, the developing unit including a housing to contain a developer, a developing member installed in the housing to supply the developer to an image support body and to form a developing area with the image support body, and a width regulating member having a variable length to adjust the developing area in a rotating axis of the developing member.

In an embodiment and utility of the present general inventive concept, there is also provided an image forming apparatus including a body, an image support body disposed in the body, and a developing unit disposed in the body, and having a housing to contain a developer, a developing member installed in the housing to supply the developer to an image support body and to form a developing area with the image support body, and a width regulating member having a variable length to adjust the developing area in a rotating axis of the developing member.

The developing unit may be a replaceable developing unit to be detachably attached to the body to supply the developer to the image support body.

In an embodiment and utility of the present general inventive concept, there is also provided a developing unit including a housing to contain a developer, a developing member to supply the developer through a developing area, and a regulating member having a first length variable in a first direction and a second direction variable in a second direction to adjust the developing area of the developer.

In an embodiment and utility of the present general inventive concept, there is also provided a developing unit including a housing to contain a developer; a developing member having a sleeve rotatably disposed in the housing to supply the developer to an external body, and a regulating member disposed around the sleeve, and having a length variable according to a relative location with respect to a rotating direction of the sleeve between the developing member and the external body.

In an embodiment and utility of the present general inventive concept, there is also provided a developing unit including a housing to contain a developer, a developing member having a magnetic cylinder having a plurality of poles, and a sleeve rotatably disposed around the magnetic cylinder in the housing to supply the developer to an external body, and a regulating member disposed around the sleeve, and having a length variable according to a location of the plurality of poles of the magnetic cylinder with respect to the external body In an embodiment and utility of the present general inventive concept, there is also provided a developing unit including a housing to contain a developer, a developing member having a magnetic cylinder having at least two different poles, and a sleeve rotatably disposed around the magnetic cylinder in the housing to supply the developer to an external body, and a regulating member disposed around the sleeve, and having at least two different portions having different lengths to corresponding to the respective at least two different poles.

The regulating member may include a portion to corresponding to at least one of the at least two different poles to regulate a thickness of the developer formed on the sleeve

BRIEF DESCRIPTION OF THE DRAWINGS

The above and/or other aspects and utilities of the present general inventive concept will become apparent and more readily appreciated from the following description of the exemplary embodiments, taken in conjunction with the accompanying drawings, in which.

DETAILED DESCRIPTION OF THE PREFERRED EMBODIMENTS

Figure 1:
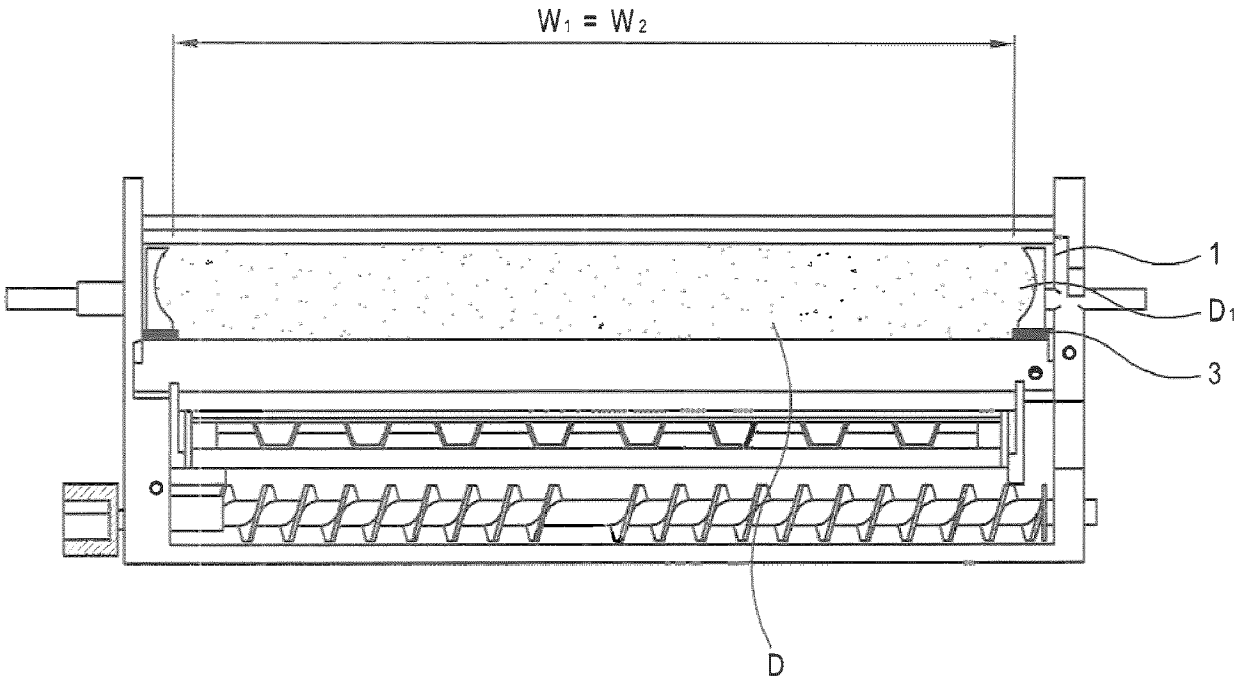
RELATED ART FIG. 1
FIG. 1 is a plan view illustrating a conventional developing unit.

Reference will now be made in detail to the embodiments of the present general inventive concept, examples of which are illustrated in the accompanying drawings, wherein like reference numerals refer to like elements throughout. The exemplary embodiments are described below so as to explain the present general inventive concept by referring to the figures.

Referring to FIGS. 4 to 7, a developing unit according to an exemplary embodiment of the present general inventive concept includes a housing 30 to contain a developer 20, a developing member 40 to form a visible image on an image support body 80 (see FIG. 6) from a latent image formed on the image support body 80 by electrification and exposure, a thickness regulating member 50 to regulate the thickness of the developer 20 on the developing member 40, and a width regulating member 60 to regulate the width of the developer 20 on the developing member 40.

The above-described developing unit can be disposed or installed in a body (housing) of an image forming apparatus. The developing unit can be a consumable and replaceable. In this case, the developing unit can be replaced by a new developing unit in the image forming apparatus.

The developing unit may further include augers 70 arranged inside of the housing 30. The augers 70 evenly supply the developer 20 in the housing 30 to the developing member 40.

The developer 20 may be a bi-component developer made of a color toner 21 and a carrier 25 carrying the toner 21. The carrier 25 is made of a magnetic material for carrying the toner 21 in the housing 30 toward the image support body 80. The toner 21 and the carrier 25 move by rotation of the augers 70 and electrified at a predetermined electric potential due to friction therebetween during movement. Due to the frictional electrification, the toner 21 adheres onto the carrier 25 and is supplied to the developing member 40 together with the carrier 25.

The developing member 40 includes a magnetic cylinder 41 having a catch pole N2 and a main pole N1, and a sleeve 45 installed to rotate on the magnetic cylinder 41. The sleeve 45 is spaced from the image support body 80 at a predetermined gap.

A conventional magnetic cylinder and a conventional sleeve can be used as the magnetic cylinder 41 and the sleeve 45 of the developing unit. In this case, the width regulating member 60 can be installed in a conventional developing unit, so that the width regulating member 60 can have the required structure and the desired performance which will be described hereinafter.

When the developing unit is detachably attached to the body of the image forming apparatus or fixedly mounted in the body of the image forming apparatus, the sleeve 45 can be movably disposed in the body of the image forming apparatus to rotate with respect to the developing unit, and the magnetic cylinder 41, the thickness regulating member 50, and the width regulating member 60 can be stationary with respect to at least one of the sleeve 45 and the developing unit.

The catch pole N2 picks up the developer 20 supplied through the augers 70 by a magnetic force so that the developer 20 can be adsorbed onto the sleeve 45. The developer 20 adsorbed onto the sleeve 45 forms a developer layer having a predetermined width. The width of the developer layer is determined by a magnetization width $W_M$ of the plurality of magnetic poles constituting the magnetic cylinder 41.

The main pole N1 is arranged to face the image support body 80 and fixes the carrier 25 among the developer 20 on the sleeve 45. The toner 21 electrified at a predetermined electric potential is supplied to the image support body 80 by an electric potential difference between the sleeve 45 and the image support body 80.

Figure 6:
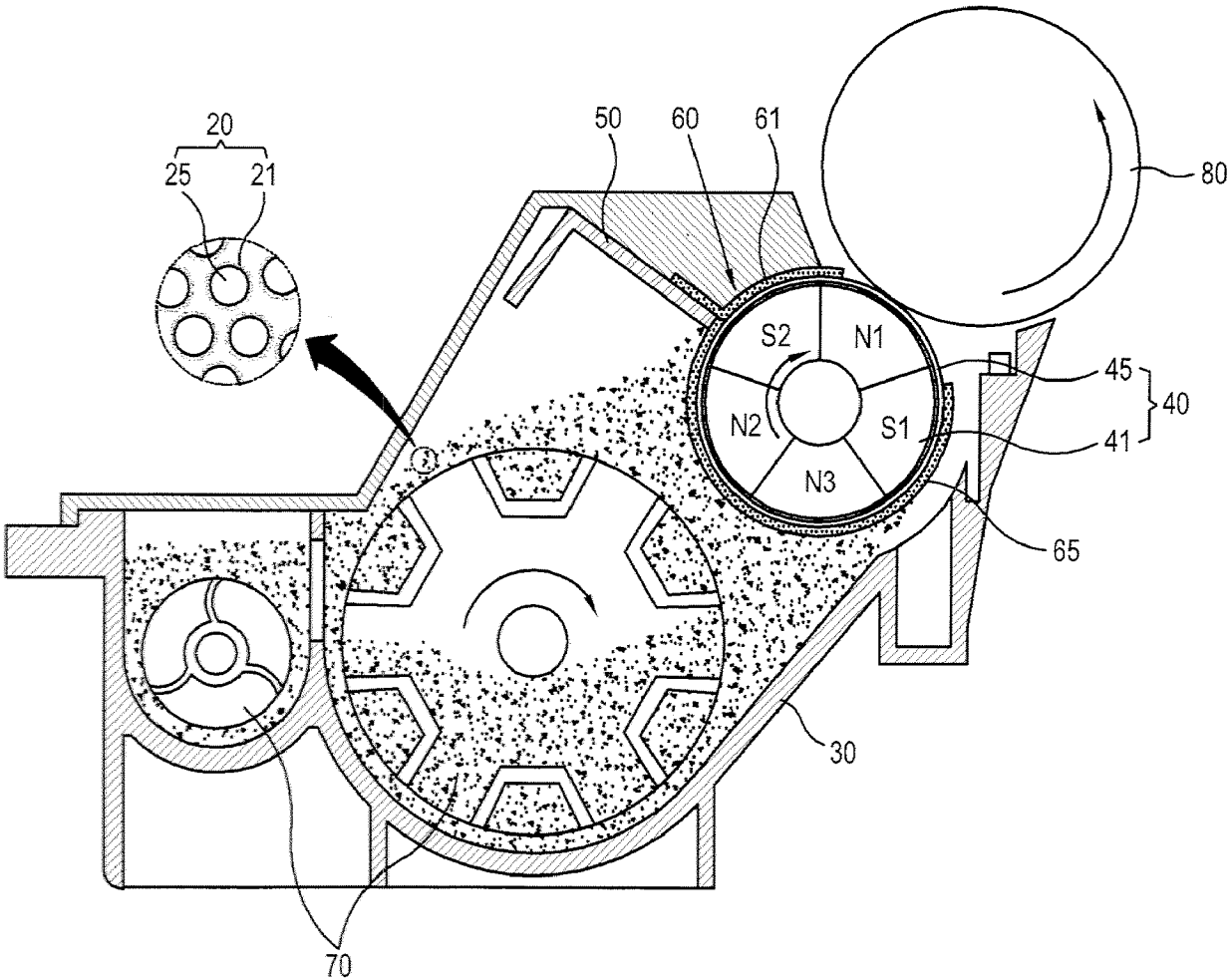
FIG. 6 is a sectional view taken along line VI-VI in FIG. 4.
Figure 7:
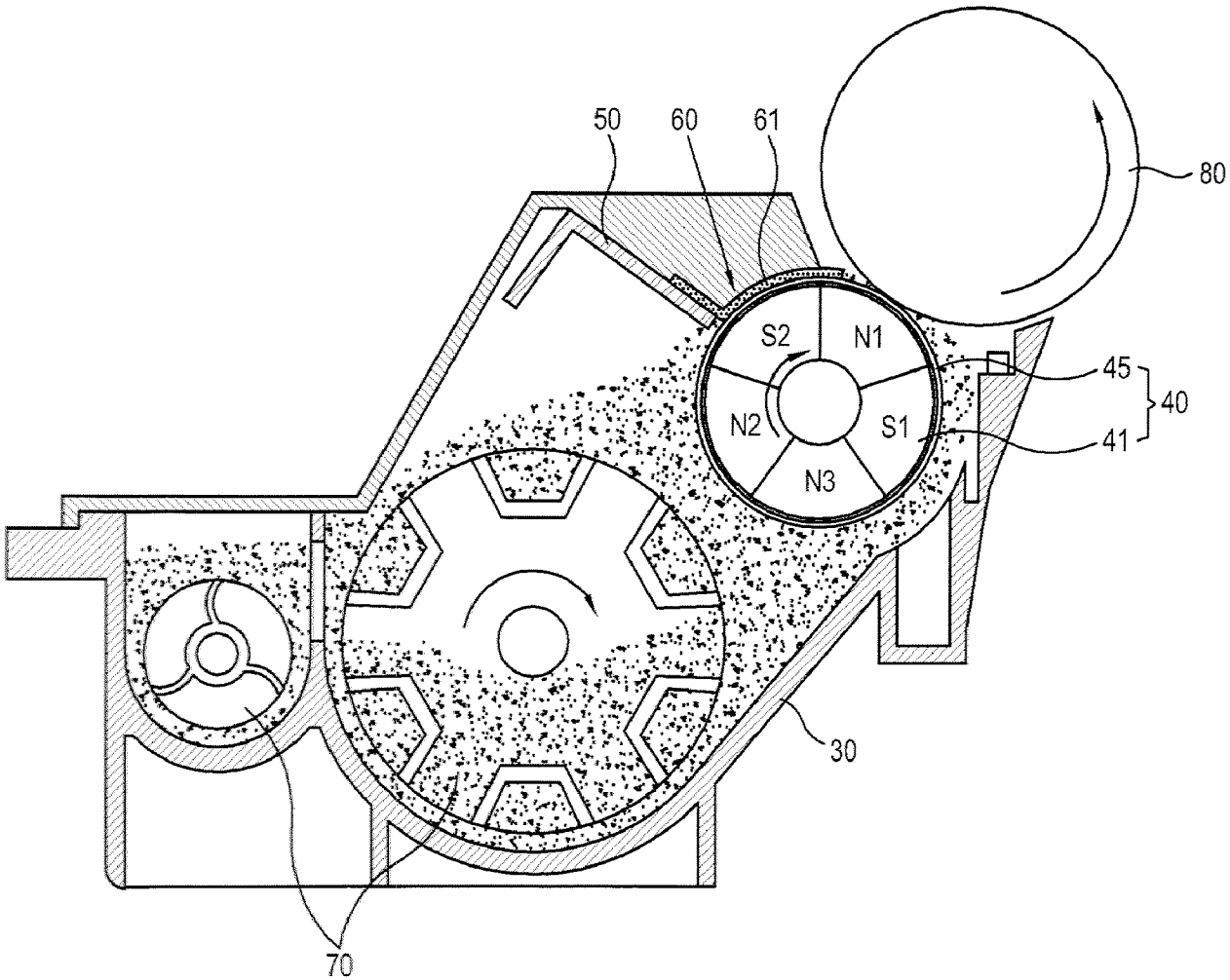
FIG. 7 is a sectional view taken along line VII-VII in FIG. 4.

The magnetic cylinder 41 may further include at least one feeding pole S1 and S2, and a separating pole N3. In FIGS. 6 and 7, a first and a second feeding poles S1 and S2 are illustrated by way of example. The first feeding pole S1 feeds the developer 20, particularly, the carrier 25 remaining on the sleeve 41 after passing through the image support body 80 back to the housing 30. The second feeding pole S2 feeds the developer 20 picked up by the catch pole N2 and adhered onto the sleeve 41 toward the main pole N1. The separating pole N3 is arranged between the first feeding pole S1 and the catch pole N2 and separates the developer 20 from the sleeve 45 into the housing 30.

In FIGS. 6 and 7, the main pole N1, the catch pole N2, the first and second poles S1 and S2, and the separating pole N3 have magnetic poles of N, N, S, S, and N, respectively. However, the arrangement and the number of the feeding poles are only examples, and may be modified within the scope of the present invention.

The thickness regulating member 50 is provided in a position facing the second feeding pole S2 between the main pole N1 and the catch pole N2, and regulates the thickness of the developer layer formed on the sleeve 45.

The thickness regulating member 50 is arranged along a lengthwise direction of the sleeve 45, being spaced from the sleeve 45 at a predetermined gap. Accordingly, as the sleeve 45 rotates, the developer layer on the sleeve 45 is regulated to have a thickness corresponding to the gap between the thickness regulating member 50 and the sleeve 45.

The width regulating member 60 is provided at opposite end parts of the sleeve 45, and regulates the width of the developer layer on the sleeve 45, to thereby prevent developer leakage and image loss. The width regulating member 60 regulates the width of the developer layer to satisfy the following formula 1:

$$W_M \geqq W_{D2} \geqq W_{D1} \geqq W_{Imax}$$

Here, $W_M$ refers to a magnetization width of the magnetic cylinder 41; $W_{D2}$ refers to a width of the developer layer at the catch pole N2; $W_{D1}$ refers to a width of the developer layer from the catch pole N2 or the position of the thickness regulating member 50 to a developing area formed between the sleeve 45 and the image support body 80; and $W_{Imax}$ refers to a maximum width of the developer layer capable of being formed on the image support body 80.

Here, the developing area is referred to as an effective area formed in a direction parallel to a rotation axis of the developing unit to supply a developer to an effective image to be formed on an image support body and/or to be printed on a printing medium.

Figure 2:
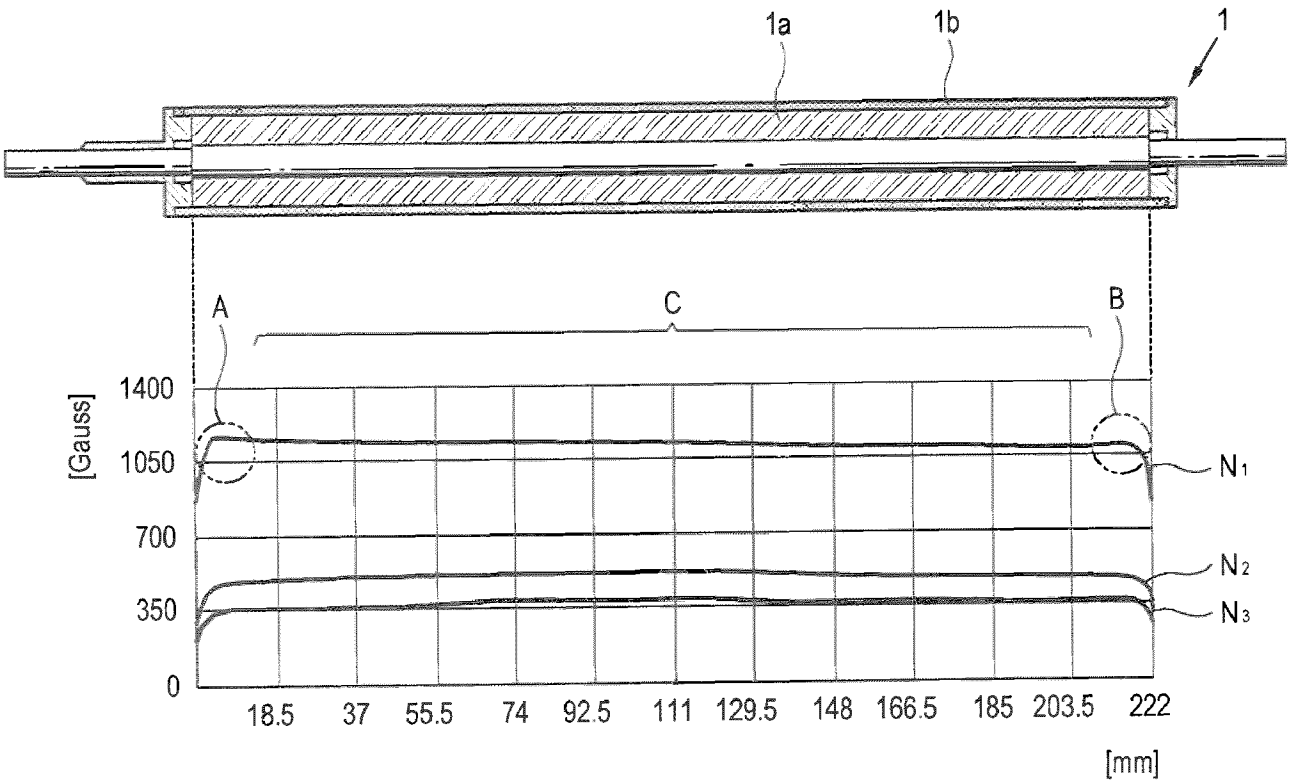
RELATED ART FIG. 2
FIG. 2 illustrates a magnetic force distribution in an axial direction of a magnetic cylinder with respect to a main pole, a catch pole and a feeding pole of the magnetic cylinder in the conventional developing unit in FIG. 1.
Figure 3:
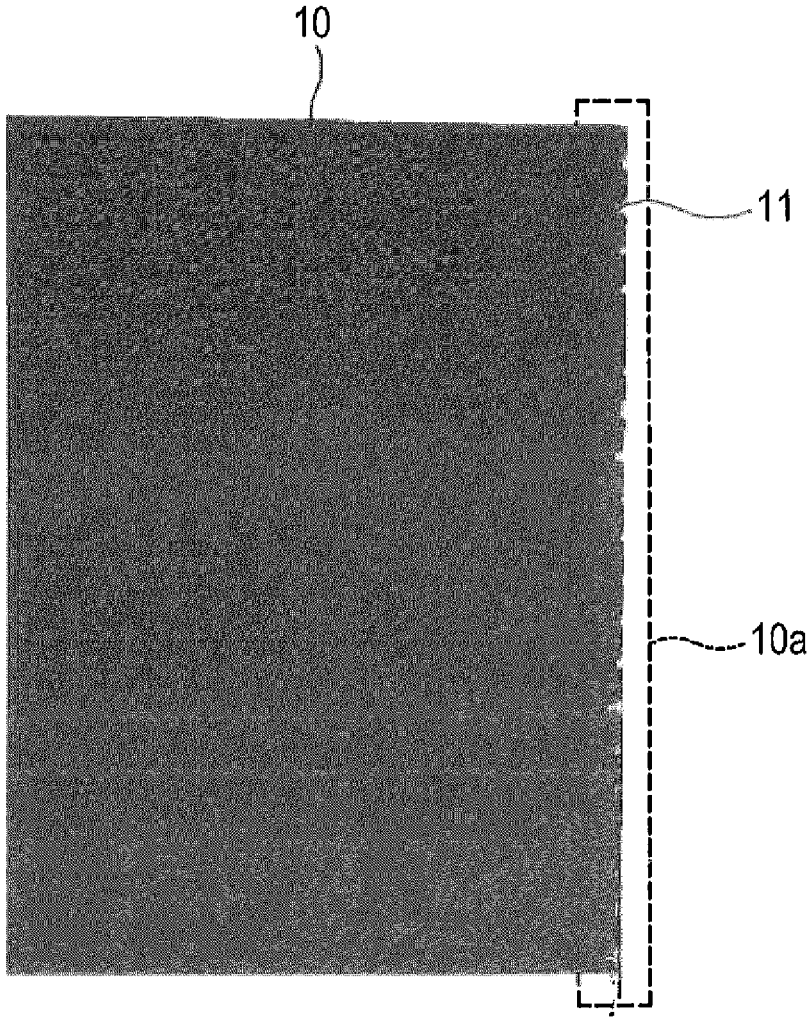
RELATED ART FIG. 3
FIG. 3 illustrates image loss in the conventional developing unit in FIG. 1.
Figure 4:
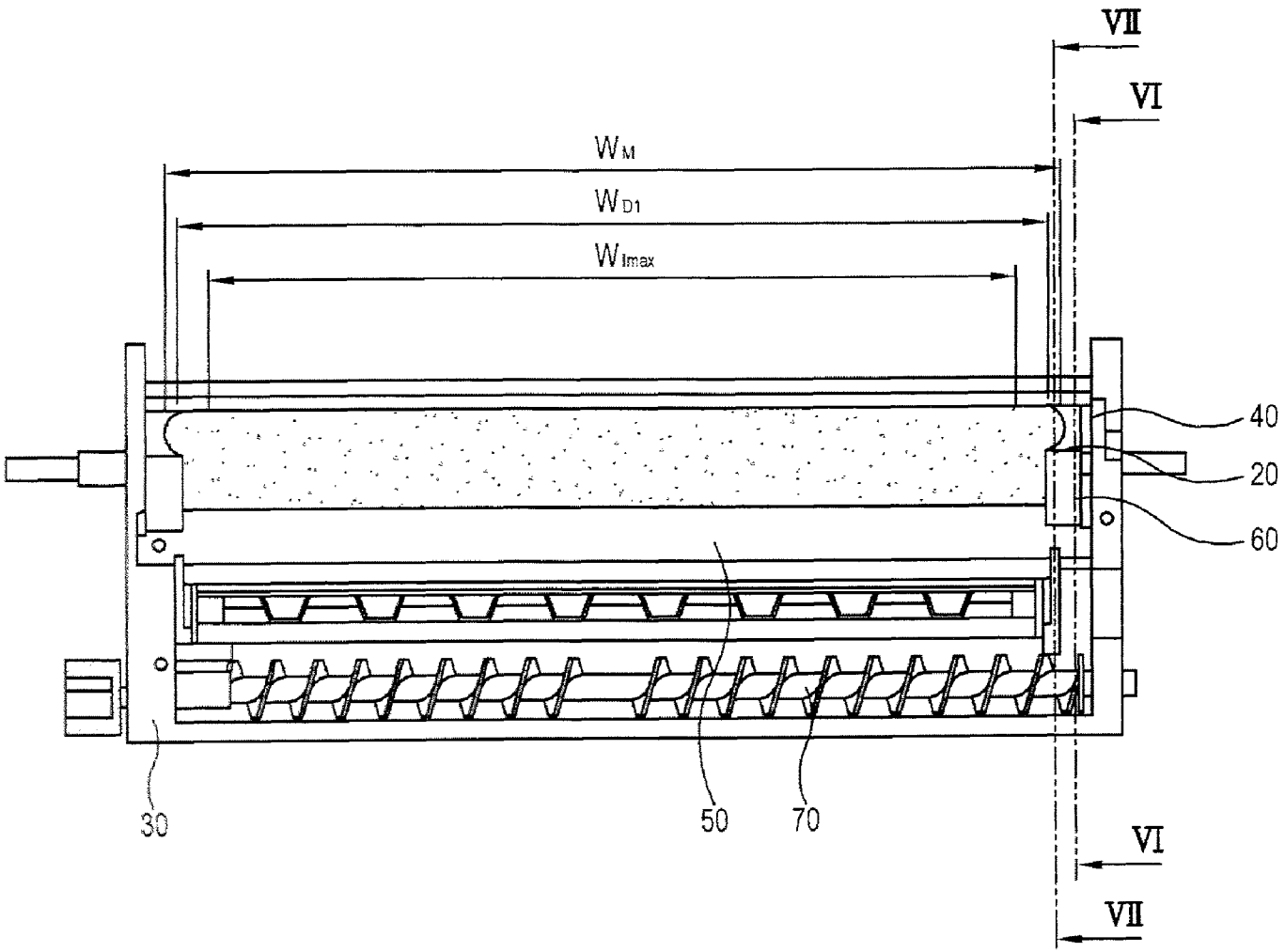
FIG. 4 is a plan view illustrating an interior of a developing unit according to an exemplary embodiment of the present general inventive concept.

If the width $W_{D1}$ is smaller than the width $W_M$ as in the formula 1, the edge effect of a magnetic field generated at the opposite end parts of the magnetization width is insignificant. That is, even if a portion of an axial magnetic force characteristic of the magnetic cylinder occurs as illustrated in FIG. 2, the edge effect of the magnetic field is beyond the width of the developer layer.

Further, if the formula 1 is satisfied, although the developer spreads towards the opposite end parts of the sleeve 45 at the developing area, the developer can stay within the magnetization width, to thereby prevent scattering of the developer at the opposite end parts of the sleeve 45.

Furthermore, since the width $W_{D1}$ of the developer layer between the thickness regulating member 50 and the developing area is smaller than the upstream width $W_{D2}$ of the developer layer, unnecessary consumption of the developer at the opposite end parts of the developer layer can be prevented, and thus, image loss due to deficiency of the developer can be also prevented.

Figure 5:
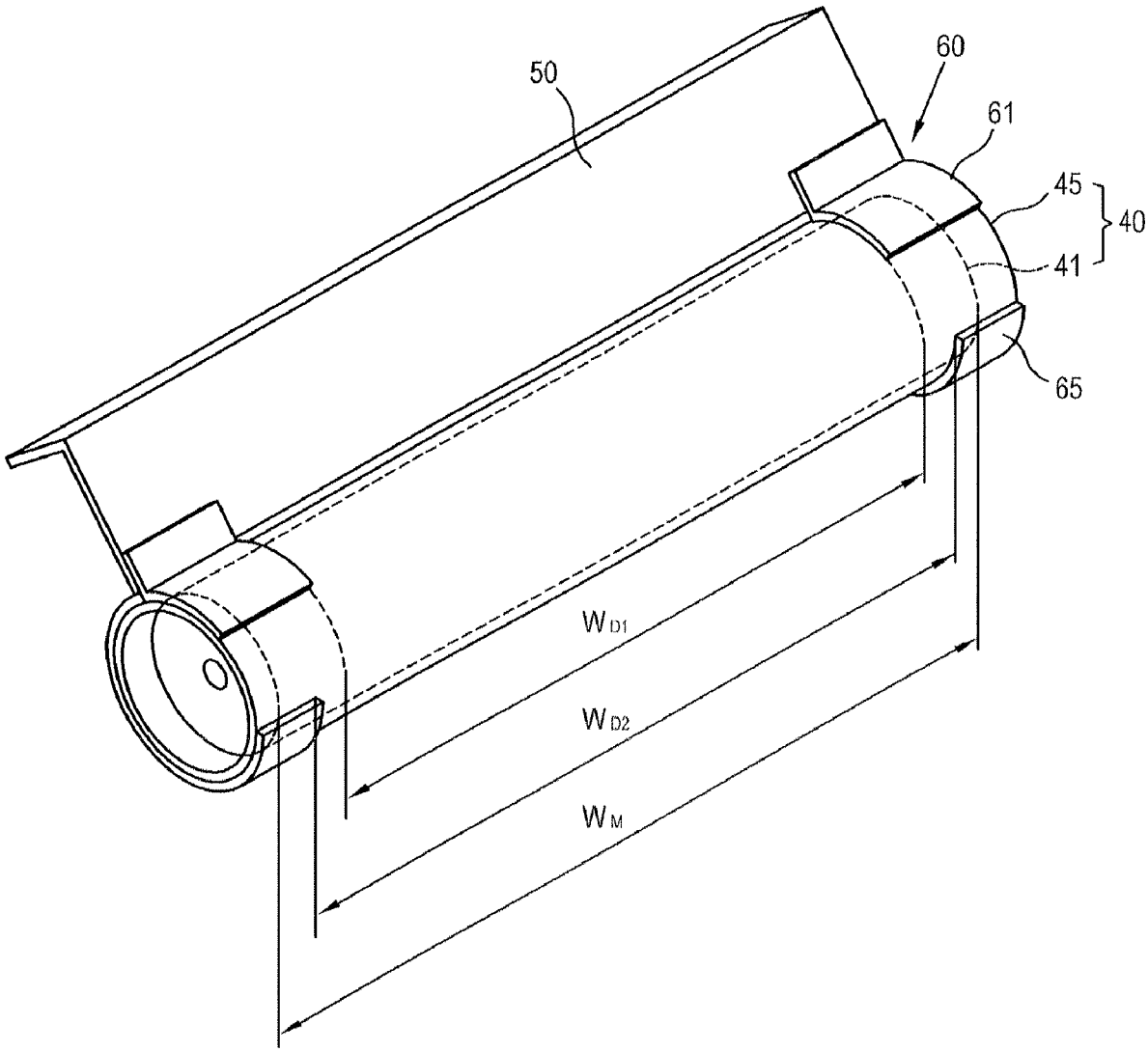
FIG. 5 is a perspective view of a main part of the developing unit in FIG. 4.

In order to keep the widths $W_{D1}$ and $W_{D2}$ of the developer layer as described above, the width regulating member 60 includes a first and a second width regulating members 61 and 65 as illustrated in FIGS. 5 to 7.

The first width regulating member 61 regulates the width of the developer layer to have the width $W_{D1}$. To this end, as illustrated in FIGS. 5 and 7, the first width regulating member 61 is mounted to the housing 30 to be arranged between the thickness regulating member 50 and the developing area at opposite end parts of the developing member 40. The first width regulating member 61 is disposed adjacent to or disposed to contact the opposite end parts of the sleeve 45. The first width regulating member 61 is made of an elastic sealing member to reduce friction with respect to the rotating sleeve 45 and to prevent leakage of the developer through the first width regulating member 61.

The second width regulating member 65 is arranged over the first feeding pole S1, the separating pole N3, the catch pole N2 and part of the second feeding pole S2, in contact with the opposite end parts of the sleeve 45, as illustrated in FIG. 6, to regulate the width $W_{D2}$ of the developer layer and to prevent leakage of the developer when a portion of the sleeve 45 corresponding to the main pole N1 faces the image support body 80. The second width regulating member 65 may be also made of a sealing member.

The width regulating member 60 may be referred to an area adjusting member to adjust an area of the developer with respect to an outer circumferential surface of the sleeve 45. The regulating member 60 may also be referred to an axial length adjusting member to adjust a longitudinal length of the developer with respect to a rotating axis of the sleeve 45. therefore, an area or the length of the developer to be supplied from the sleeve 45 to the image support body can be adjusted according to utilities of the present general inventive concept.

The width regulating member 60 may be referred to a structure formed between the sleeve 45 and the image support body to cover at least a portion of the outer circumferential surface of the sleeve 45. The structure of the width regulating member 60 can be variable with respect to a rotating axis of the sleeve 45 according to a circular (rotating) direction of the sleeve 45. Accordingly, the length of the structure of the width regulating member 60 in the direction is variable with respect to the location of the poles of the magnetic cylinder 41 such that a portion of the sleeve 45 moves along the poles of the magnetic cylinder 41 to effectively receive the developer and to effectively supply the received developer to the image support body.

Figure 8:
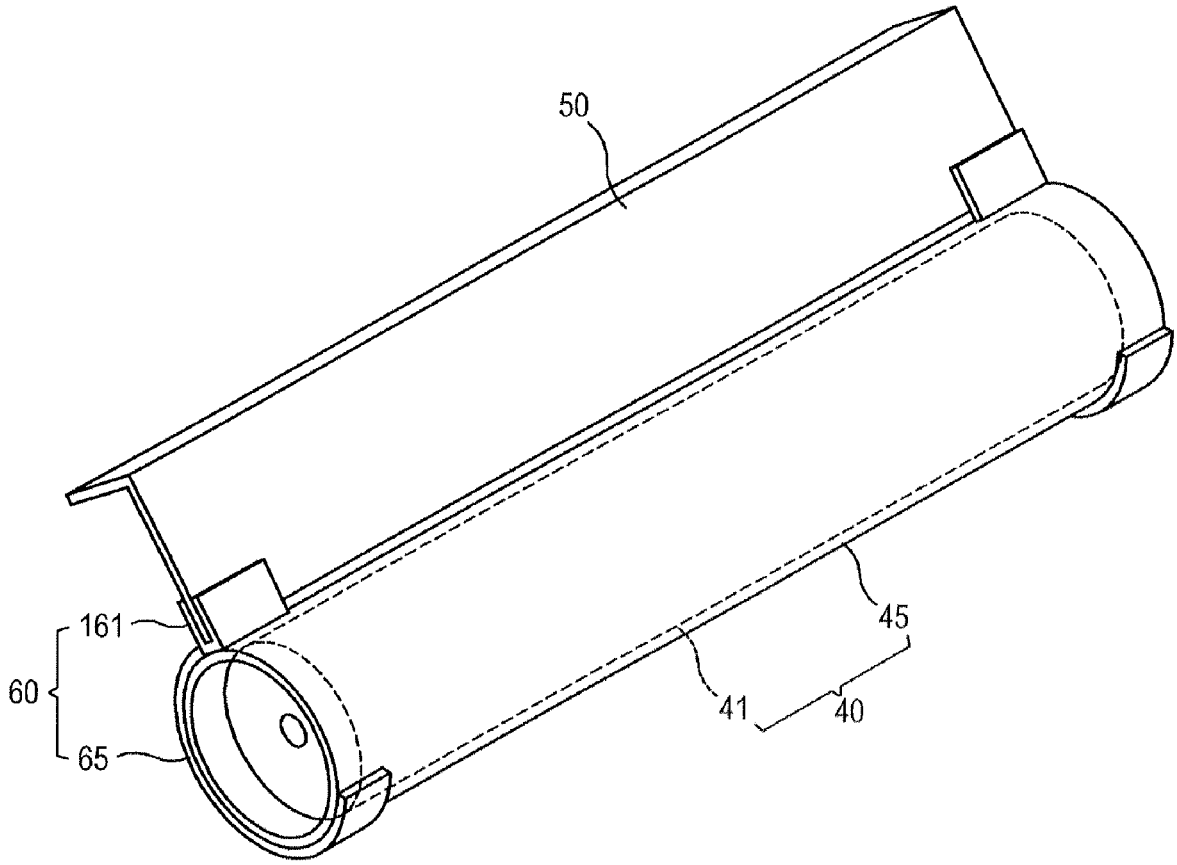
FIG. 8 illustrates a width regulating member of a developing unit according to an exemplary embodiment of the present general inventive concept.

According to another exemplary embodiment, the width regulating member 60 may include a first and a second width regulating members 161 and 65, as illustrated in FIG. 8. The second width regulating member 65 is the same as that of the first embodiment described above.

The first width regulating member 161 is provided at a lower end part of the thickness regulating member 50 in contact with the opposite end parts of the sleeve 45 to regulate the width $W_{D1}$ of the developer layer.

Figure 9:
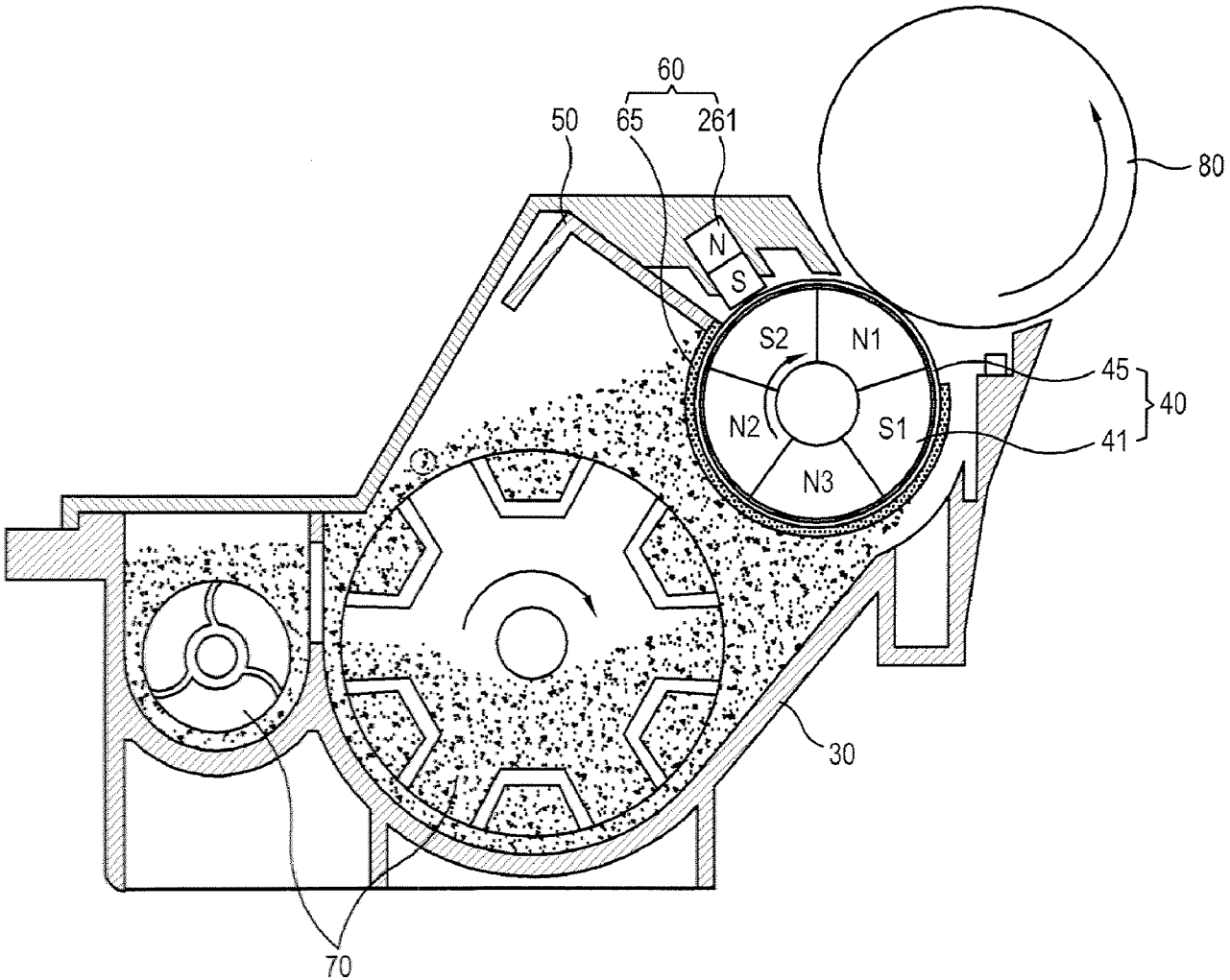
FIG. 9 illustrates a width regulating member of a developing unit according to another exemplary embodiment of the present general inventive concept.

According to still another embodiment, the width regulating member 60 may include a first and a second width regulating member 261 and 65, as illustrated in FIG. 9. The second width regulating member 65 is the same as that of the first embodiment described above.

The first width regulating member 261 may include a regulating magnet arranged at the opposite end parts of the sleeve 45 between the thickness regulating member 50 and the main pole N1, as illustrated in FIG. 9, to regulate the developer layer to have the width $W_{D1}$ by a magnetic force. In FIG. 9, an S pole of the regulating magnet faces the second feeding pole S2 to generate a repulsive force, so as to regulate the developer to be within the width $W_{D1}$. Alternatively, an N pole of the regulating magnet may face the second feeding pole S2 to generate an attractive force, so as to regulate the developer to be within the width $W_{D1}$.

The location of the width regulating member 60 may be modified. For example, the first width regulating member 61 may be arranged at the catch pole N2. In this case, the first width regulating member 61 may be made of a sealing member and/or a regulating magnet.

In the above-described embodiments, the pair of width regulating members 60 is arranged at the opposite end parts of the sleeve 45, but one width regulating member 60 may be arranged at one end part thereof.

Hereinafter, an operation of the developing unit according to the present general inventive concept will be described.

The developer 20 contained in the housing 30 is supplied to the developing member 40 by the augers 70. During the supply process, frictional electrification occurs between the toner 21 and the carrier 25, and thus, the toner 21 adheres to the carrier 25.

The developer supplied to the developing member 40 is picked up by the catch pole N2 to then be adsorbed onto the sleeve 45. The developer layer formed on the sleeve 45 is regulated by the second width regulating member 65 to have the width $W_{D2}$ which is the same as or smaller than the magnetization width $W_M$. The developer layer is then regulated by the thickness regulating member 50 to have a thickness corresponding to the gap between the sleeve 45 and the thickness regulating member 50.

The developer layer passed through the gap moves to the developing area at which the main pole N1 is disposed, according to rotation of the sleeve 45. At the developing area, the toner 21 moves from the sleeve 45 to the image support body 80 by an electrostatic force formed between the image support body 80 and the developing member 40, to form a visible image onto the image support body 80.

As described above, since the width $W_{D1}$ of the developer layer entering into the developing area is regulated to be smaller than the magnetization width $W_M$ and the width $W_{D2}$, non-uniformity of the developer layer thickness and scattering or loss of the developer at the opposite end parts of the sleeve 45 can be prevented, and thus, pollution due to the developer scattering and image loss due to the developer loss can be also prevented.

The developer including the carrier and the remaining toner, which has passed through the developing area, is fed towards the separating pole N3 via the first feeding pole S1 according to rotation of the sleeve 45, and then is separated from the sleeve 45 into the housing 30. Then, the above process is repeated.

Figure 10:
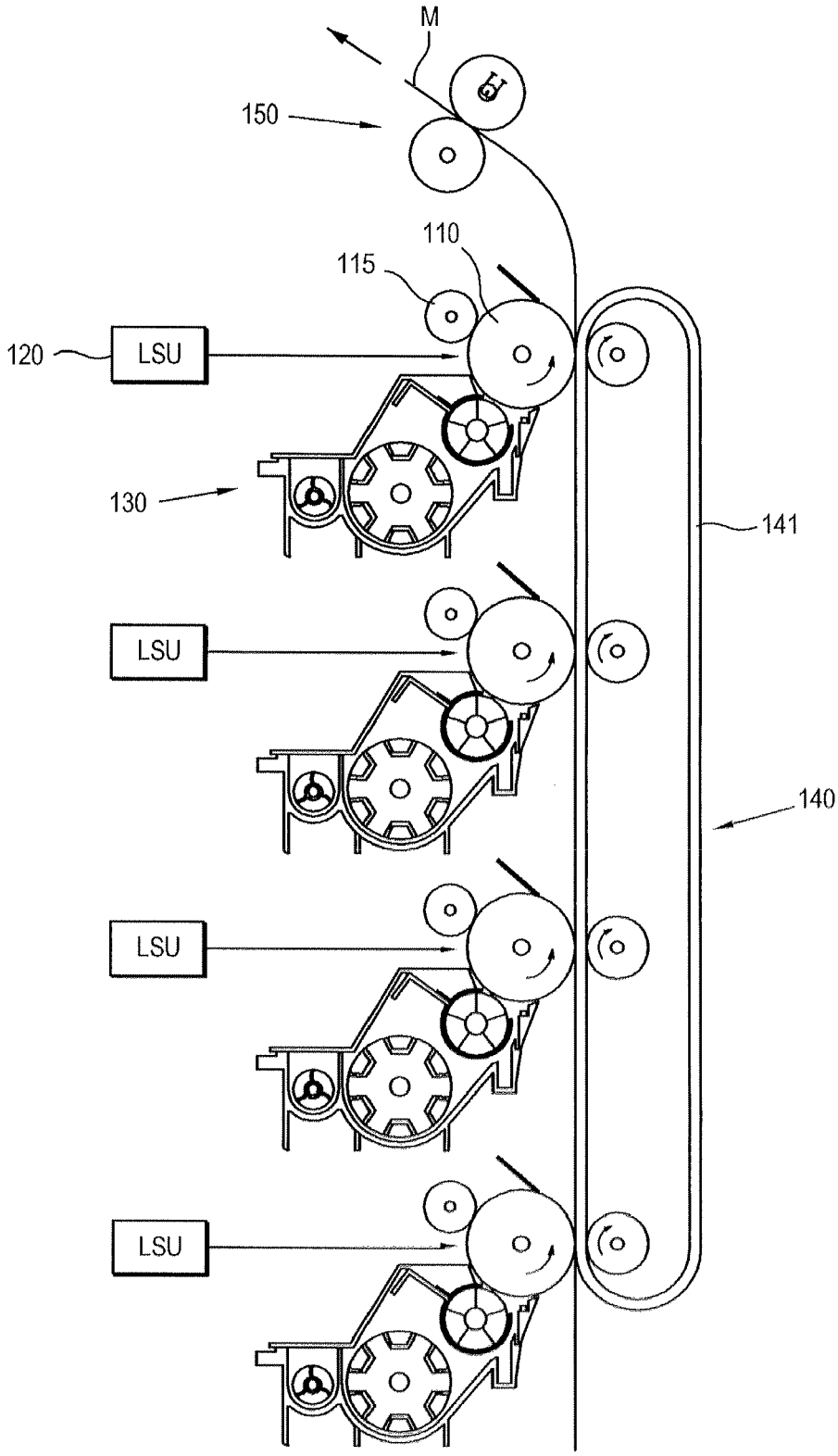
FIG. 10 schematically illustrates an image forming apparatus according to an exemplary embodiment of the present general inventive concept.

FIG. 10 schematically illustrates an image forming apparatus according to an exemplary embodiment of the present general inventive concept.

Referring to FIG. 10, the image forming apparatus includes: an image support body 110; an electrifying member 115 electrifying the image support body 110; an exposure unit 120 forming a latent image on the image support body 110; a developing unit 130 developing a visible image with respect to the latent image formed on the image support body 110; a transfer unit 140 transferring the visible image formed on the image support body 130 to a printing medium M; and a fusing unit 150 fixing the visible image transferred to the printing medium. In FIG. 10, a tandem type color image forming apparatus is exemplified, and in this case, the image support body 110, the electrifying member 115, the exposure unit 120 and the developing unit 130 are plurally provided corresponding to a plurality of colors along a feeding path of the printing medium M, respectively.

The exposure unit 120 includes a light scan unit (LSU) for scanning a light beam onto each color image support body 110, to form a latent image on the image support body 110 electrified at a predetermined electric potential.

The developing unit 130 supplies the toner to the image support body 110 to form a visible image or a toner image corresponding to the latent image by means of bi-component development. The developing unit 130 has the same configuration as the developing unit described above referring to FIGS. 4 through 9.

The transfer unit 140 is arranged to face the plurality of the image support bodies 110, with the printing medium M moving along its feeding path being interposed therebetween, and transfers the toner image formed on the image support body 110 to the printing medium M. To this end, the transfer unit 140 includes a transfer belt 141 arranged to face the plurality of image support bodies 110.

The fusing unit 150 applies pressure and heat to the printing medium M passing through the fusing unit 150 to fix the transferred image onto the printing medium M.

Although FIG. 10 illustrates the color image forming apparatus, it is possible that the developing unit of FIGS. 4-9 can be used in a mono image forming apparatus. It is also possible that the developing unit of FIGS. 4-9 can be used in an image forming apparatus having a transfer belt to receive an image from the image support body 110 and to transfer the received image to a printing medium. The above-described image forming apparatus is well known, and thus, detailed descriptions thereof will be omitted.

As described above, in the developing unit and the image forming apparatus employing the same according to the present general inventive concept, the width of the developer layer at a position entering the developing area is regulated to be smaller than the magnetization width, to thereby prevent scattering and loss of the developer at the opposite end parts of the sleeve, thereby preventing pollution and image loss and improving a life span of the developer and the developing unit.

Although a few exemplary embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A developing unit to develop an image on an image support body, comprising:

a housing to contain a developer having a toner and a carrier;

a magnetic cylinder including a catch pole to pick up the developer in the housing and a main pole arranged to face the image support body and to hold the carrier of the developer;

a sleeve installed to rotate on the magnetic cylinder and on which a developer layer is formed;

a thickness regulating member to regulate a thickness of the developer layer; and a width regulating member to regulate a width of the developer layer on the sleeve to satisfy the following formula:

$$W_M \geqq W_{D2} \geqq W_{D1} \geqq W_{Imax},$$

where $W_M$ refers to a magnetization width of the magnetic cylinder, $W_{D2}$ refers to a width of the developer layer at the catch pole, $W_{D1}$ refers to a width of the developer layer between the catch pole or the thickness regulating member and a developing area formed between the sleeve and the image support body, and the $W_{Imax}$ refers to a maximum image width capable of being developed on the image support body.

2. The developing unit according to claim 1, wherein the thickness regulating member is spaced from the sleeve at a predetermined gap along a lengthwise direction of the sleeve between the catch pole and the main pole.

3. The developing unit according to claim 2, wherein the magnetic cylinder further comprises:

at least one feeding pole to feed the developer layer on the sleeve; and a separating pole to separate the developer from the sleeve.

4. The developing unit according to claim 1, wherein the width regulating member comprises:

a first width regulating member arranged at opposite end parts of the sleeve to regulate the developer layer to maintain the width $W_{D1}$; and a second width regulating member arranged at the opposite end parts of the sleeve to regulate the developer layer to maintain the width $W_{D2}$, and to prevent leakage of the developer.

5. The developing unit according to claim 4, wherein the first width regulating member contacts the opposite end parts of the sleeve between the thickness regulating member and the main pole and regulates the width of the developer layer in contact with the sleeve.

6. The developing unit according to claim 4, wherein the first width regulating member is arranged at a lower end part of the thickness regulating member to contact the opposite end parts of the sleeve and regulates the width of the developer layer in contact with the sleeve.

7. The developing unit according to claim 4, wherein the first width regulating member comprises a regulating magnet which is arranged to face the opposite end parts of the sleeve between the thickness regulating member and the main pole and which regulates the width of the developer layer by a magnetic force.

8. A developing unit to develop an image on an image support body, comprising:

a housing to contain a developer;

a developing member installed in the housing to supply the developer to the image support body and to form a developing area between the developing member and the image support body;

a thickness regulating member to regulate a thickness of a developer layer formed on the developing member;

a first width regulating member disposed against the thickness regulating member, and arranged between the thickness regulating member and the developing area adjacent to at least one side of the developing member to regulate a width of the developer layer; and a second width regulating member arranged between the developing area and the thickness regulating member along a rotational direction of the developing member at at least one end part of the developing member, and regulating the width of the developer layer, wherein the developing member comprises: a magnetic cylinder having a catch pole picking up the developer in the housing, and a main pole facing the image support body and holding a carrier of the developer; and a sleeve installed to rotate on the magnetic cylinder and on which the developer layer is formed, wherein the first and second width regulating members regulate the width of the developer layer on the sleeve to satisfy the following formula:

$$W_M \geqq W_{D2} \geqq W_{D1} \geqq W_{Imax},$$

where $W_M$ refers to a magnetization width of the magnetic cylinder, $W_{D2}$ refers to a width of the developer layer at the catch pole, $W_{D1}$ refers to a width of the developer layer between the catch pole or the thickness regulating member and a developing area formed between the sleeve and the image support body, and the $W_{Imax}$ refers to a maximum image width capable of being developed on the image support body.

9. The developing unit according to claim 8, wherein the developer is a bi-component developer comprising a toner and the carrier carrying the toner.

10. The developing unit according to claim 9, wherein the first width regulating member comprises a plurality of sealing members contacting opposite end parts of the developing member and regulating the width of the developer layer in contact with the developing member.

11. An image forming apparatus comprising:

an image support body;

an electrifying member to electrify the image support body;

an exposure unit to expose the image support body to form a latent image;

a developing unit to form a visible image corresponding to the latent image on the image support body;

a transfer unit to transfer the image formed on the image support body to a printing medium; and a fusing unit to fix the image transferred on the printing medium wherein the developing unit comprises:

a housing to contain a developer;

a developing member installed in the housing to supply the developer to the image support body and to form a developing area between the developing member and the image support body;

a thickness regulating member to regulate a thickness of a developer layer formed on the developing member; and a first width regulating member disposed against the thickness regulating member, and arranged between the thickness regulating member and the developing area adjacent to at least one side of the developing member to regulate a width of the developer layer; and a second width regulating member arranged between the developing area and the thickness regulating member along a rotational direction of the developing member at at least one end part of the developing member to regulate the width of the developer layer, wherein, the developing member comprises: a magnetic cylinder comprising a catch pole to pick up the developer in the housing, and a main pole to face the image support body and to hold a carrier of the developer; and a sleeve installed to rotate on the magnetic cylinder and on which the developer layer is formed, wherein the first and second width regulating members regulate the width of the developer layer on the sleeve to satisfy the following formula:

$$W_M \geqq W_{D2} \geqq W_{D1} \geqq W_{Imax},$$

where $W_M$ refers to a magnetization width of the magnetic cylinder, $W_{D2}$ refers to a width of the developer layer at the catch pole, $W_{D1}$ refers to a width of the developer layer between the catch pole or the thickness regulating member and a developing area formed between the sleeve and the image support body, and the $W_{Imax}$ refers to a maximum image width capable of being developed on the image support body.

12. The image forming apparatus according to claim 11, wherein the developer is a bi-component developer comprising a toner and the carrier carrying the toner.

13. The developing unit according to claim 12, wherein the first width regulating member comprises a plurality of sealing members contacting opposite end parts of the developing member to regulate the developer in contact with the developing member.

14. A developing unit to develop an image on an image support body, comprising:

a housing to contain a developer having a toner and a carrier;

a magnetic cylinder including a catch pole to pick up the developer in the housing and a main pole arranged to face the image support body and to hold the carrier of the developer;

a sleeve installed to rotate on the magnetic cylinder and on which a developer layer is formed;

a thickness regulating member to regulate a thickness of the developer layer; and a width regulating member including a first width regulating member and a second width regulating member to regulate a width of the developer layer on the sleeve, wherein the first width regulating member has a first width, and the second width regulating member is disposed below the first width regulating member and has a width less than the first width of the first width regulating member.

* * * * *